US006751897B2

(12) United States Patent
Bierwith

(10) Patent No.: US 6,751,897 B2
(45) Date of Patent: Jun. 22, 2004

(54) LIP ASSEMBLY

(76) Inventor: Robert S. Bierwith, 1331 Eastshore Hwy., Berkeley, CA (US) 94710

( * ) Notice: Subject to any disclaimer, the term of this patent is extended or adjusted under 35 U.S.C. 154(b) by 162 days.

(21) Appl. No.: 10/054,332

(22) Filed: Nov. 13, 2001

(65) Prior Publication Data

US 2003/0093928 A1 May 22, 2003

Related U.S. Application Data

(60) Provisional application No. 60/253,356, filed on Nov. 27, 2000, and provisional application No. 60/305,977, filed on Jul. 16, 2001.

(51) Int. Cl.[7] ..... E02F 3/36
(52) U.S. Cl. ..... 37/446; 37/450
(58) Field of Search ..... 37/446, 449, 450, 37/451, 452, 453, 454, 460, 455, 444; 172/753, 772, 772.5, 811

(56) References Cited

U.S. PATENT DOCUMENTS

| | | | | | |
|---|---|---|---|---|---|
| 2,285,039 | A | * | 6/1942 | Lowe | 37/446 |
| 3,653,133 | A | * | 4/1972 | Black et al. | 37/450 |
| 3,762,079 | A | * | 10/1973 | Lukavich et al. | 37/451 |
| 3,851,413 | A | * | 12/1974 | Lukavich | 37/451 |
| 3,864,853 | A | * | 2/1975 | Klett et al. | 37/446 |
| 3,947,982 | A | * | 4/1976 | Mantovani | 37/450 |
| 4,238,896 | A | * | 12/1980 | Lanz et al. | 37/450 |
| 4,360,981 | A | | 11/1982 | Bierwith et al. | |
| 4,413,432 | A | | 11/1983 | Bierwith | |
| 4,570,365 | A | * | 2/1986 | Bierwith | 37/450 |
| 4,579,494 | A | | 4/1986 | Bierwith | |
| 5,052,134 | A | | 10/1991 | Bierwith | |
| 5,088,214 | A | * | 2/1992 | Jones | 37/450 |
| 5,134,793 | A | | 8/1992 | Bierwith | |
| 5,412,885 | A | * | 5/1995 | Cornelius | 37/451 |
| 5,417,518 | A | | 5/1995 | Bierwith | |
| 5,526,592 | A | * | 6/1996 | Bierwith | 37/451 |
| 5,553,409 | A | * | 9/1996 | Irving | 37/446 |
| 5,680,717 | A | | 10/1997 | Bierwith | |
| 5,852,888 | A | * | 12/1998 | Cornelius | 37/457 |
| 5,992,063 | A | * | 11/1999 | Mack | 37/450 |
| 6,032,390 | A | | 3/2000 | Bierwith | |
| 6,151,812 | A | | 11/2000 | Bierwith | |
| 6,216,368 | B1 | | 4/2001 | Bierwith | |
| 6,446,368 | B1 | * | 9/2002 | Watts | 37/450 |

FOREIGN PATENT DOCUMENTS

| | | |
|---|---|---|
| WO | WO 99/66135 | 12/1999 |

* cited by examiner

*Primary Examiner*—Victor Batson
(74) *Attorney, Agent, or Firm*—Townsend and Townsend and Crew LLP

(57) ABSTRACT

A lip assembly is disclosed. The lip assembly comprises a lip having an upper surface, a lower surface, a front portion, and a rear portion. A plurality of holes is disposed between the front portion and the rear portion. The lip also includes support members. Each support member is disposed adjacent to a hole within the plurality of holes and is positioned to inhibit movement of a tooth assembly coupled to the hole. A plurality of tooth assemblies extend away from the lip and are respectively coupled to the lip via the plurality of holes. The lip assembly may be used with an excavation bucket body.

7 Claims, 7 Drawing Sheets

LIP ASSEMBLY

CROSS-REFERENCE TO RELATED APPLICATIONS

This application claims the benefit of the filing date of U.S. Provisional Patent Application Nos. 60/253,356 filed Nov. 27, 2000, and 60/305,977 filed Jul. 16, 2001. Both of these applications are herein incorporated by reference in their entirety for all purposes.

BACKGROUND OF THE INVENTION

Many large excavators are provided with bucket assemblies. The bucket assemblies can be used to remove earth, tar sand, etc. In a typical excavator, a lip is welded to an edge of a bucket body. The lip, viewed head-on or looking into the bucket, may be skewed rearwardly at its two opposite ends. Chisel-shaped excavating teeth are coupled to the lip and are used for digging. The lip can have a means for removably securing the teeth to the lip so that worn or damaged teeth can be replaced. Damaged or worn teeth should be replaced to avoid damage to the lip and the bucket body and to maintain the effectiveness of the bucket assembly.

Replacing damaged teeth is an expensive and time-consuming task. If the teeth become worn or damaged, workers must stop any excavation taking place to replace the worn or damaged teeth. Replacement teeth for excavators are relatively expensive parts that are made from relatively large quantities of hard materials such as carbon steel. The cost of the replacement teeth as well as the cost of the manpower used to replace worn or damaged teeth with replacement teeth inevitably results in increased project costs. In addition, replacing worn or damaged teeth frequently consumes the time of many workers and can result in project delays.

One factor which contributes to the increased frequency of damaged teeth is the lateral movement of the teeth during digging. During digging, the individual teeth can move from side-to-side. The lateral movement of the teeth causes them to repeatedly contact adjacent structures such as adjacent lip shrouds. This can result in increased wear on the teeth and increased stress. Consequently, frequent replacement of the teeth is needed in many instances.

Accordingly, it would be desirable to provide a lip assembly for an excavation bucket assembly which can reduce the frequency of replacing worn or damaged teeth. Embodiments of the invention are directed to this and other problems.

SUMMARY OF THE INVENTION

Embodiments of the invention are directed to lip assemblies, and in particular, lip assemblies for excavation bucket assemblies. In embodiments of the invention, tooth assemblies which are used in excavation bucket assemblies have restricted movement in a lateral direction. Contact between the tooth assemblies and other structures such as lip shrouds is reduced. This decreases the wear on the tooth assemblies and consequently increases their useful life. As a result, the frequency of replacing damaged or worn teeth is decreased in comparison to conventional excavation bucket assemblies.

One embodiment of the invention is directed to a lip assembly comprising a lip having an upper surface, a lower surface, a front portion, and a rear portion. A plurality of holes are disposed between the front portion and the rear portion, and each of the holes extends from the upper surface to the lower surface of the lip. The lip has a plurality of support members and each support member is disposed adjacent to a hole from the plurality of holes and inhibits the lateral movement of a tooth assembly coupled to the hole. The assembly also includes a plurality of tooth assemblies extending away from the lip. Each tooth assembly is respectively coupled to the lip via the plurality of holes.

Another embodiment of the invention is directed to a lip assembly comprising: (a) a U-shaped lip having (i) an upper surface, (ii) a lower surface, (iii) a front portion having projections and valleys, (iv) a rear portion, (v) a first plurality of holes disposed between the front portion and the rear portion and extending from the upper surface to the lower surface, (vi) a second plurality of holes disposed at the front portion, (vii) a plurality of ribs at the lower surface of the lip, wherein each hole of the first plurality of holes is disposed between a pair of ribs to inhibit the lateral movement of a tooth assembly disposed between the pair of ribs, and (viii) a plurality of lip shrouds respectively disposed on the projections of the front portion of the lip. The lip assembly also includes (b) a plurality of tooth assemblies extending away from the lip and respectively coupled to the lip via the first plurality of holes.

Another embodiment of the invention is directed to an excavation bucket assembly comprising: (a) an excavation bucket having a front portion, and (b) a lip assembly. The lip assembly comprises a lip having an upper surface, a lower surface, a front portion, and a rear portion. A plurality of holes is disposed between the front portion and the rear portion, and each of the holes extends from the upper surface to the lower surface of the lip. The lip has a plurality of support members and each support member is disposed adjacent to a hole from the plurality of holes and inhibits the lateral movement of a tooth assembly coupled to the hole. The lip assembly also includes a plurality of tooth assemblies extending away from the lip. Each tooth assembly is respectively coupled to the lip via the plurality of holes.

These and other embodiments are described in further detail below.

BRIEF DESCRIPTION OF THE DRAWINGS

FIG. 6(*b*) shows a frontal view of the block element shown in FIG. 6(*a*).

DESCRIPTION OF THE SPECIFIC EMBODIMENTS

Embodiments of the invention are directed to lip assemblies and excavation bucket assemblies including lip assemblies. The excavation bucket assemblies and lip assemblies according to embodiments of the invention can be used in a variety of industries including the mining and construction industries. They may be used with any suitable excavation apparatus. Examples of excavation apparatuses which use the bucket assemblies and lip assemblies include backhoes, power shovels, front-end loaders, dragline equipment, etc.

In a typical bucket assembly, a bucket body can be coupled to a lip assembly. The bucket body may have a rear wall, side walls and a bottom wall to contain an excavated material. The lip assembly can be coupled to a front portion of the bucket body to form a bucket assembly. The lip assembly may have a lip, a plurality of tooth assemblies, and a plurality of lip shrouds. The lip shrouds and the tooth assemblies can be coupled to the front portion of the lip, and the plurality of lip shrouds can be interspersed between the plurality of tooth assemblies.

Figure 1:
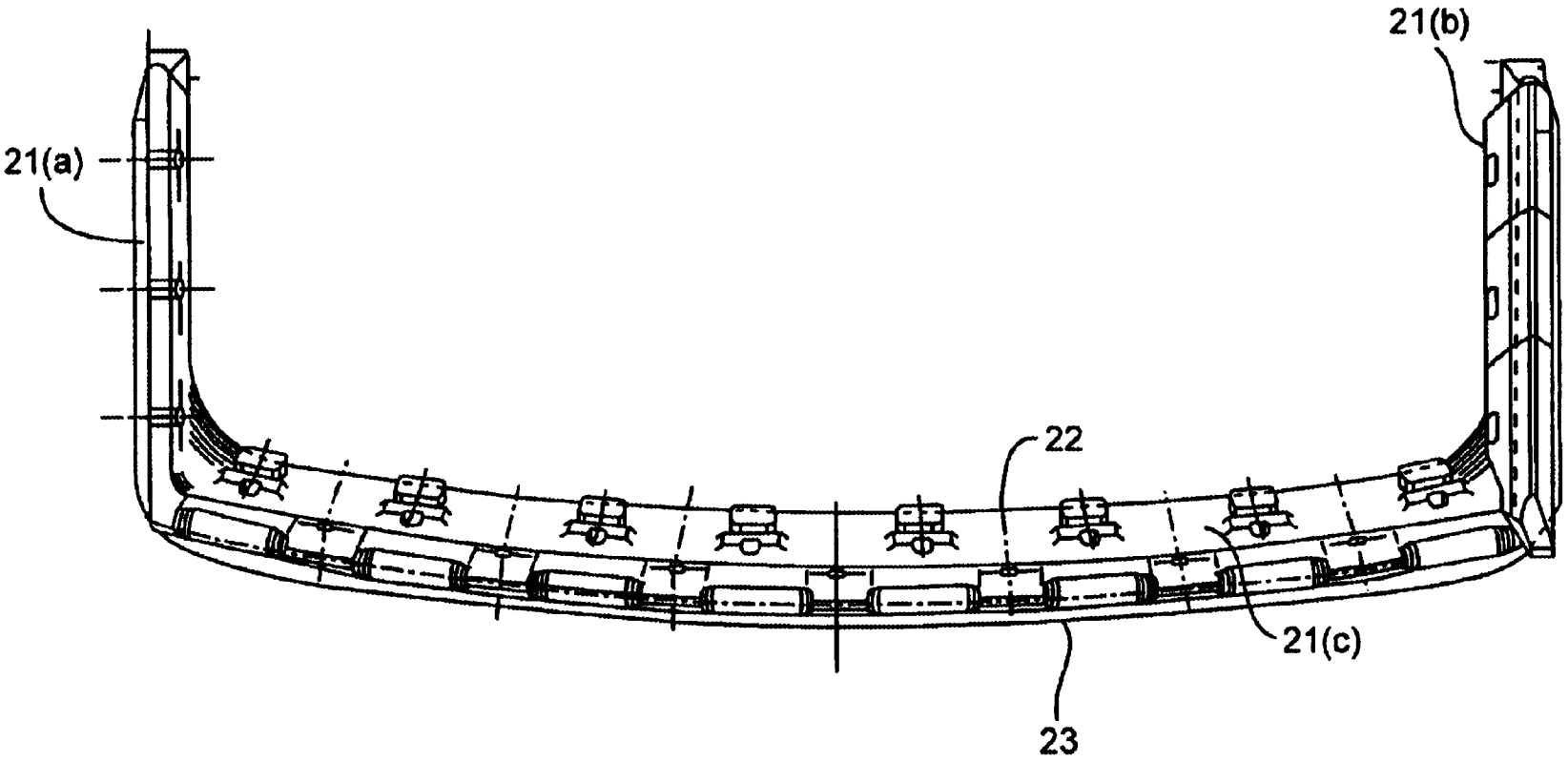
FIG. 1 shows a perspective view of a lip.

The lip of the lip assembly may be of any suitable size or configuration. FIG. 1, for example, shows a generally U-shaped lip 20. The lip 20 includes a first lip wing 21(*a*) and a second lip wing 21(*b*), as well as a front portion 23 and a rear portion 22. The lip wings 21(*a*), 21(*b*) may be skewed rearwardly in relation to the front portion 23 of the lip 20, and the distance between the lip wings 21(*a*), 21(*b*) may span several yards in some embodiments. An upper surface 21(*c*) of the lip 20 is also shown in this figure, and a lower surface (not shown) is on the opposite side of the lip 20 as the upper surface 21(*c*). Although the lip 20 may have any suitable thickness, the thickness of the lip 20 can be on the order of five inches or more (e.g., 5.5 inches). When used, the rear portion 22 of the lip 20 would typically be mounted to the front edge of an excavation bucket body (not shown) to form an excavation bucket assembly. Welding can be used to mount the rear portion 22 of the lip 20 to the front edge of the excavation bucket body.

Figure 2:
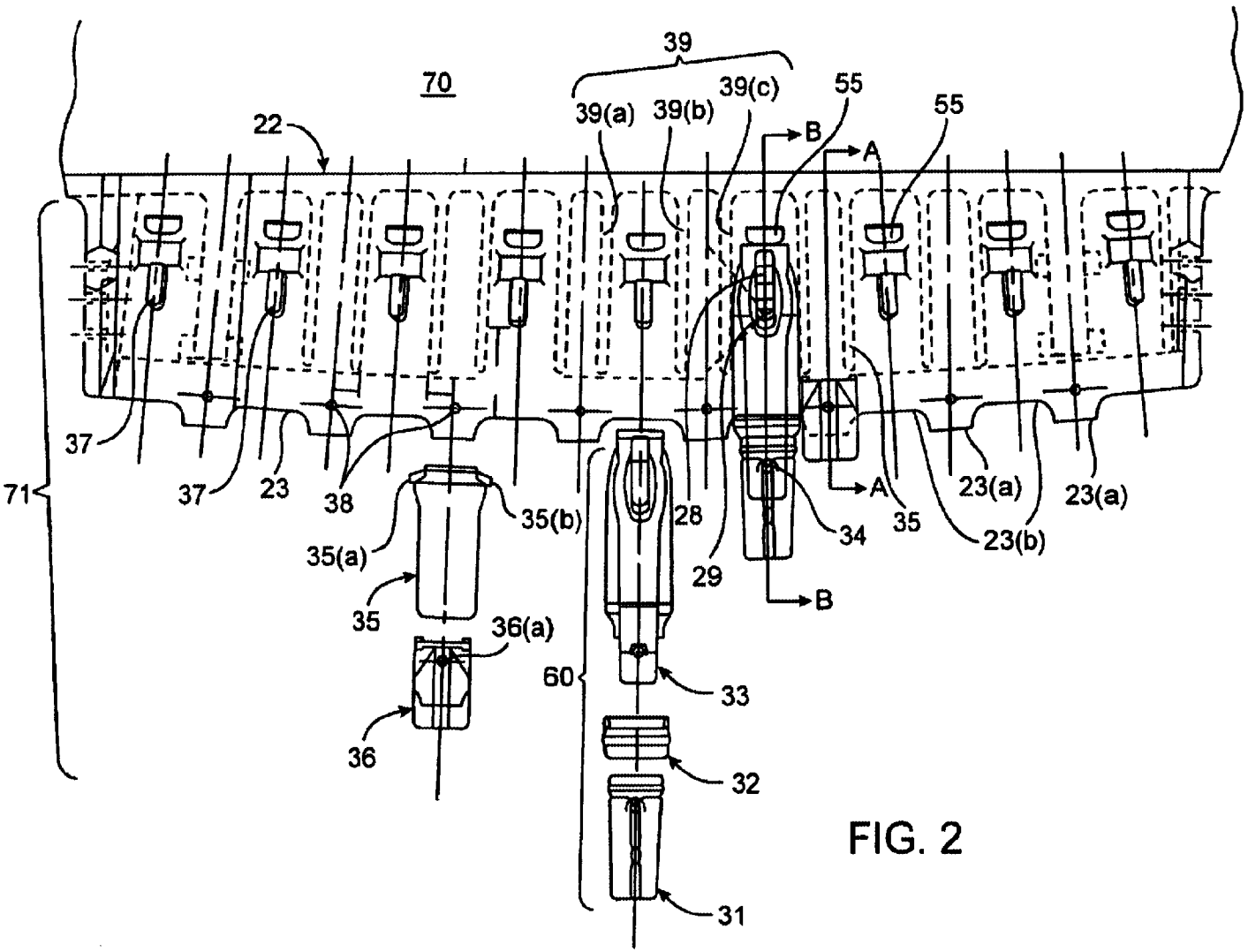
FIG. 2 shows a partial top view of an excavation bucket assembly including a lip assembly according to an embodiment of the invention. Stabilizing members are shown in FIG. 2 by invisible lines.

FIG. 2 shows a portion of an excavation bucket assembly with a lip assembly 71 according to an embodiment of the invention. A front portion of a bucket body 70 is coupled to a rear portion 22 of the lip assembly 71. Coupling may occur in any suitable manner. For example, in preferred embodiments, the lip 20 of the lip assembly 71 is welded to the front portion of the bucket body 70.

The lip assembly 71 includes a lip 20 with a front portion 23 and a rear portion 22. The front portion 23 includes a number of projections 23(*a*) and valleys 23(*b*) producing an undulating profile when viewed from the top. Tooth assemblies 60 are mounted over the valleys 23(*b*) and between the projections 23(*a*), while lip shrouds 36 are mounted over the projections 23(*a*) and between the valleys 23(*b*). The lip shrouds 36 protect the lip 20 during digging. Like the teeth 31, the lip shrouds 36 can be replaced periodically when they become worn or damaged. Protective wearplates 35 with edge regions 35(*a*), 35(*b*) may be disposed on the upper surface of the lip 20 to protect the upper surface of the lip 20. Adjacent block members 55 on opposite sides of a wearplate 35 may secure the edge regions 35(*a*), 35(*b*) of a wearplate 35 to the upper surface of the lip 20. The plurality of block members 55 are respectively positioned at the ends of the adaptors 33 and the tooth assemblies 60 mounted on the lip 20. The block members 55 can inhibit the lateral movement of the adaptors 33 and the tooth assemblies 60 and extend their working life. Most or all of the parts of the excavation bucket assembly and the lip assembly can be made of a hard metal alloy such as steel.

A first plurality of holes 37 is present between the front portion 23 and the rear portion 22 of the lip 20. In this example, the first plurality of holes 37 consists of a generally straight line of holes. Each of the holes from the first plurality of holes 37 extends from an upper surface of the lip 20 to the lower surface of the lip 20. Each of the holes from the first plurality of holes 37 may also have any suitable shape. For example, each of the holes from the first plurality of holes 37 in this example have an oblong shape.

A plurality of tooth assemblies 60 may be respectively coupled to the lip 20 via the first plurality of holes 37 using any type of securing mechanism. For example, a C-clamp 28, a locking wedge 29, and a wedge block (not shown) combination may be used to secure the tooth assembly 60 to the lip 20. When the tooth assemblies 60 are secured to the lip 20, the tooth assemblies 60 extend away from the lip 20.

A second plurality of holes 38 is located at the front portion 23 of the lip 20. Each of the holes of the second plurality of holes 38 lies between adjacent valleys 23(*b*). The second plurality of holes 38 may be in a generally straight line, and each of the holes 38 may have any suitable shape. For example, each of the holes from the second plurality of holes 38 in this example have a circular shape.

Lip shrouds 36 are secured to the lip 20 via the second plurality of holes 38 and over the projections 23(*a*). Each lip shroud 36 can have pair of legs which are disposed on the upper and lower surfaces of the front portion of the lip 20 when the lip shroud 36 is mounted to the lip 20. Each lip shroud 36 may also optionally have sidewalls. The sidewalls and the legs may form a pocket in which the lip projections 23(*a*) are received. By providing sidewalls to the lip shrouds 36, the side-to-side movement of the lip shrouds 36 is restricted as the lip shrouds 36 conform to the shape of the respective lip projections 23(*a*). The likelihood that the lip shrouds 36 will contact adjacent tooth assemblies 60 is reduced, thus increasing the useful life of the tooth assemblies 60.

Each tooth assembly 60 comprises a tooth 31. Preferably, each tooth assembly 60 comprises a tooth 31, an adapter 33, and an adapter shroud 32. In these embodiments, the adapter shroud 32 covers a portion of the adapter 33 and is disposed between the adapter 33 and the tooth 31. When they are assembled together, holes in the tooth 31 and the adapter 33 are aligned and are secured together with a connector such as a pin (not shown). If the tooth 31 becomes worn, the tooth 31 can be replaced without replacing other parts of the tooth assembly 60. The connector can be removed along with the worn tooth and a new connector and tooth can be coupled to the adapter 33. Suitable tooth assemblies and other components are described in U.S. Pat. No. 5,526,592 and U.S. patent application Ser. No. 09/183,478, filed Oct. 29, 1998, both of which are herein incorporated by reference in their entirety.

Any suitable number of stabilizing members 39 may be present on the lip 20 at any suitable location. In the example shown in FIG. 2, for example, pairs of stabilizing members 39(*b*), 39(*c*) are disposed between adjacent holes from the first plurality of holes 37. Also, for each hole from the first plurality of holes 37, a pair of stabilizing members 39(*a*), 39(*b*) may be disposed adjacent to, and on opposite sides of the hole. The pair of stabilizing members 39(*a*), 39(*b*) on opposite sides of the hole inhibit the lateral movement of a tooth assembly 60 disposed between them. Contact with other adjacent structures (e.g., the lip shrouds) is inhibited, thus decreasing the wear on the components of the tooth assemblies 60. Furthermore, the stabilizing members 39 also provide extra support for the lip 20 itself so that the structural integrity of the lip 20 is increased in comparison to a lip without stabilizing members.

The stabilizing members 39 shown in FIG. 2 can be characterized as parallel ribs. When the ribs are disposed on opposite sides of a tooth assembly on the lip, the movement of the tooth assembly to both sides of the tooth assembly is restricted by the presence of the ribs. Embodiments of the invention, however, are not limited to those embodiments specifically shown in the Figures. Other configurations or structures may be used to inhibit the lateral movement of the tooth assemblies. For example, in an alternative embodiment, instead of two ribs disposed between adjacent holes, only one rib can be present between adjacent holes from the first plurality of holes 37. In an another alternative embodiment, the stabilizing member could be a single block of material (e.g., a block of steel) between adjacent holes, instead of two ribs between adjacent holes. The block of material could inhibit the lateral movement of tooth assemblies disposed on both sides of the block.

The stabilizing members 39 may have any suitable spacing or orientation. Preferably, the stabilizing members 39 are ribs which are parallel and extend in the same direction as the tooth assemblies 60. Stabilizing members 39 which are on opposite sides of a hole from the first plurality of holes 37 are preferably spaced so that they are adapted to receive a tooth assembly 60. For example, the spacing between two stabilizing members 39(*a*), 39(*b*) on opposite sides of a hole may be approximately equal to, or slightly greater than, the width of a tooth assembly 60 or an adapter 33 for a tooth assembly 60. The spaced stabilizing members 39(*a*), 39(*b*) can form a slot which is configured to receive a tooth assembly 60 or the adapter 33 for the tooth assembly 60. As shown in FIG. 2, the stabilizing members 39 extend from a rear portion 22 of the lip 20 towards the front portion 23 of the lip 20. The ends of the stabilizing members 39 preferably terminate short of the front portion 23 of the lip 20 (e.g., in a central region of the lip 20) or in the region where the adapter 33 lies. The lateral movement of each of the tooth assemblies 60 is inhibited by restricting the movement of a corresponding tooth assembly adapter 33 with the stabilizing members 39.

The stabilizing members 39 may be formed in any suitable manner. For example, the stabilizing members 39 may be separately formed. Then, the stabilizing members 39 may be welded onto the main body of the lip 20. In other embodiments, the stabilizing members 39 may be secured to the main body of the lip 20 via a securing mechanism such as a pin or a bolt.

The stabilizing members 39 are preferably disposed at least at the lower surface of the lip 20. By providing the stabilizing members 39 at the lower surface of the lip 20, the stabilizing members 39 will not obstruct the path of excavated material moving from the front portion of the lip 20 to the rear portion 22 of the lip 20 and into the bucket body 70. Also, as previously noted, the stabilizing members 39 also inhibit the lateral movement of the tooth assemblies 60 and improve the structural integrity of the lip 20.

Figure 3:
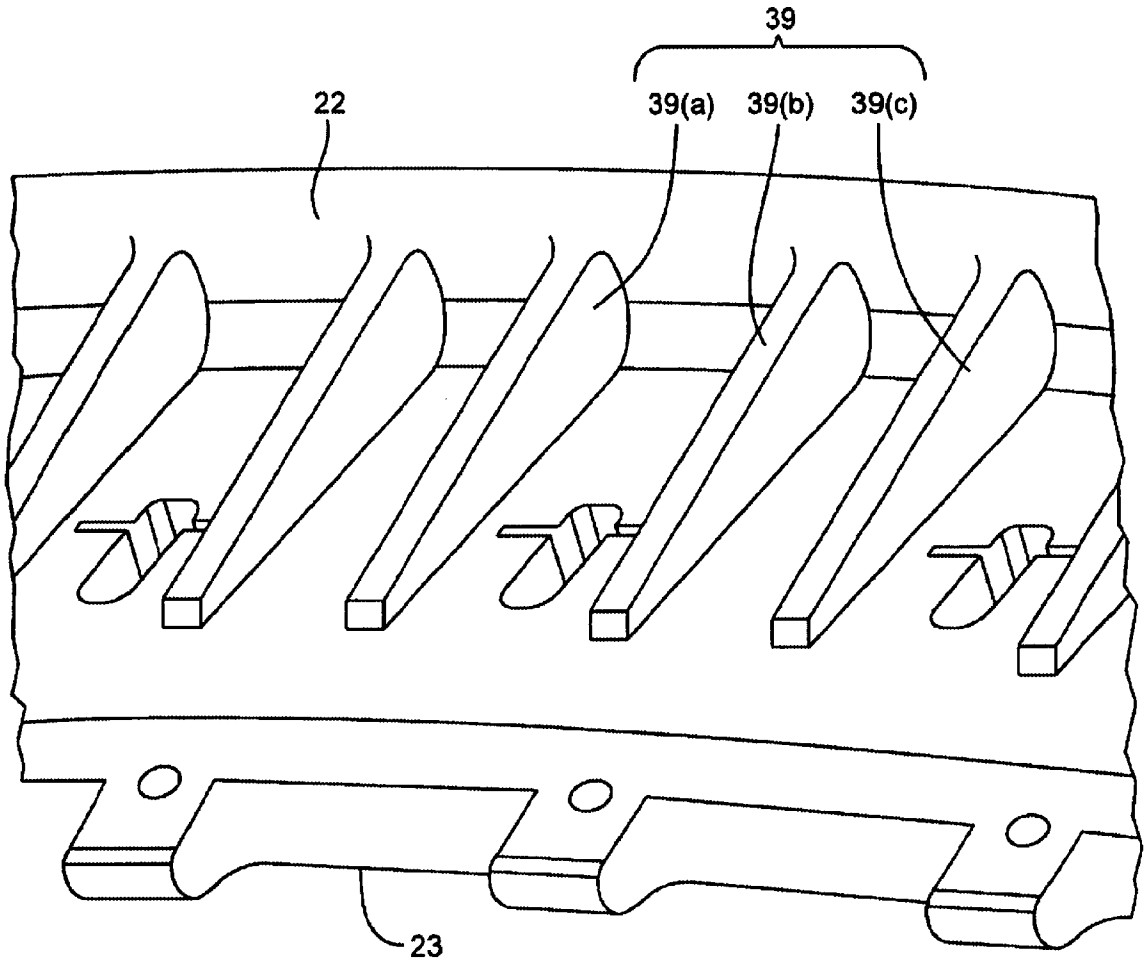
FIG. 3 shows a partial perspective view of the underside of a lip according to an embodiment of the invention.

A view of the underside of the lip 20 is shown in FIG. 3. FIG. 3 shows a lip 20 and a plurality of stabilizing members 39. As also shown in FIG. 2, pairs of stabilizing members 39(*a*), 39(*b*) are disposed adjacent to, and on opposite sides of, respective holes from the first plurality of holes. As shown in this Figure, the thickness of the stabilizing members 39 decreases in a direction from the rear portion 22 of the lip 20 to the front portion 23 of the lip 20.

Figure 4:
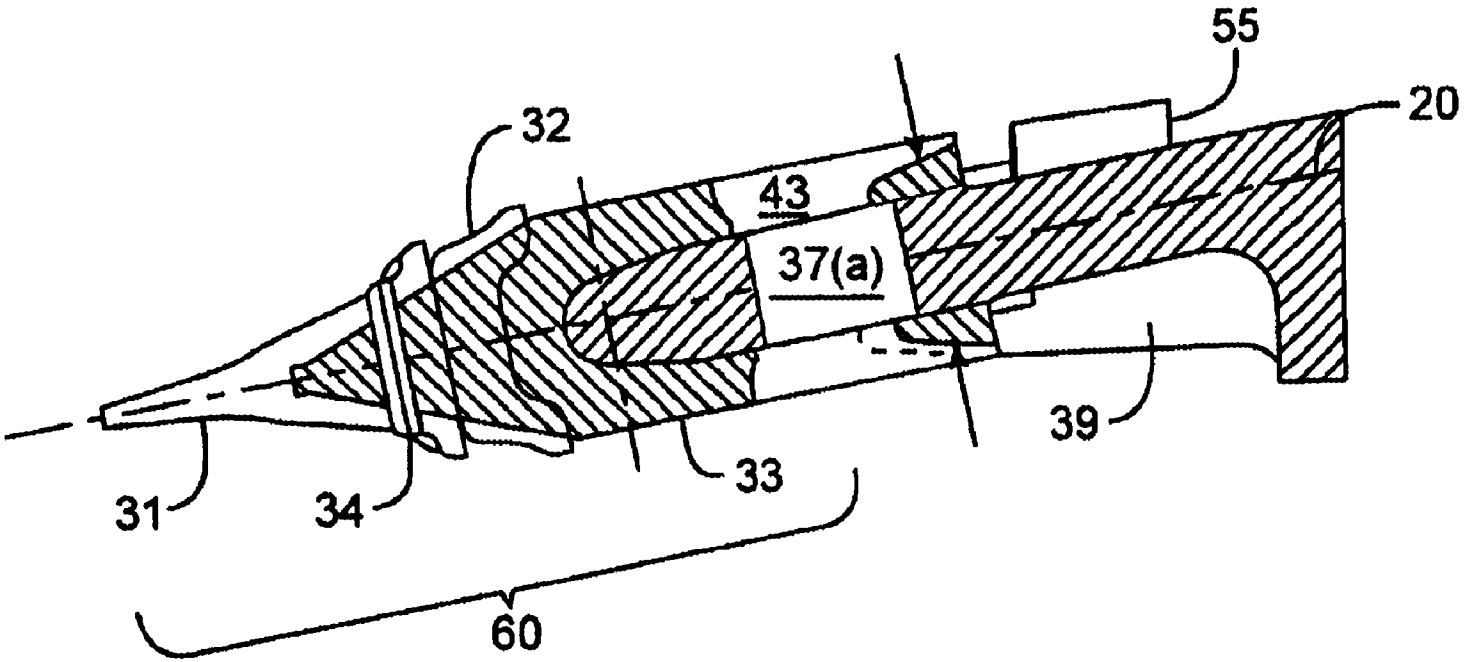
FIG. 4 shows a side cross-sectional view of a portion of the lip assembly along the line B—B.

FIG. 4 shows a side cross-sectional view of a tooth assembly 60 disposed over a lip 20. An adapter 33 of a tooth assembly 60 is on a lip 20. A hole 43 in the adapter 33 and a hole 37 of the first plurality of holes in the lip 20 are aligned. A mechanism such as a C-clamp and a wedge (not shown) can be used to secure the adapter 33 and the lip 20 together via the aligned holes 37, 43. An adapter shroud 32 lies over the adapter 33 to protect the adapter 33, and a tooth 31 is disposed over the adapter shroud 32. The adapter shroud 32 is disposed between the tooth 31 and the adapter 33 when the tooth assembly 60 is secured to the lip 20 and extends from the rear portion of the lip 20 to a central region of the lip 20. A pin 34 or other securing mechanism may be used to secure the tooth 31 to the adapter shroud 32. A stabilizing member 39 is shown on the underside of the lip 20. The stabilizing member 39 provides structural support for the lip 39 and also inhibits the lateral movement of the tooth assembly 60 during use. A block element 55 is present at a rear end of the adaptor 33 and can inhibit the movement of the adaptor 33.

Figure 5:
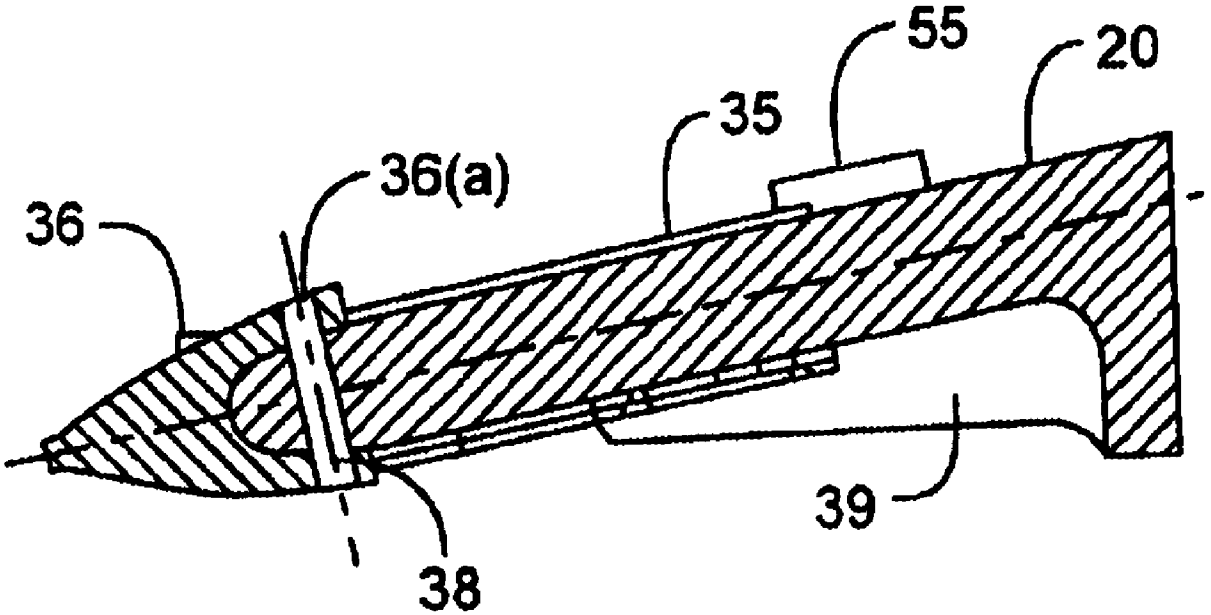
FIG. 5 shows a side cross-sectional view of a portion of lip assembly shown in FIG. 2 along the line A—A.

FIG. 5 shows a side cross-sectional view of a lip shroud 36 disposed over a lip 20. A hole 36(*a*) in the lip shroud and a lip hole 38 from the second plurality of holes are aligned with each other. A pin (not shown) or other securing mechanism may be disposed within the aligned holes to secure the lip shroud 36 to the lip 20. A wearplate 35 may be disposed on the upper surface of the lip 20 to protect the lip 20 from being worn or damaged by the material being excavated. A stabilizing member 39 is disposed on the underside of the lip 39, and is disposed to a side of the wearplate 35. A block element 55 is present at a rear end of the wearplate 35 and secures the wearplate 35 to the lip 20.

Figure 6A:
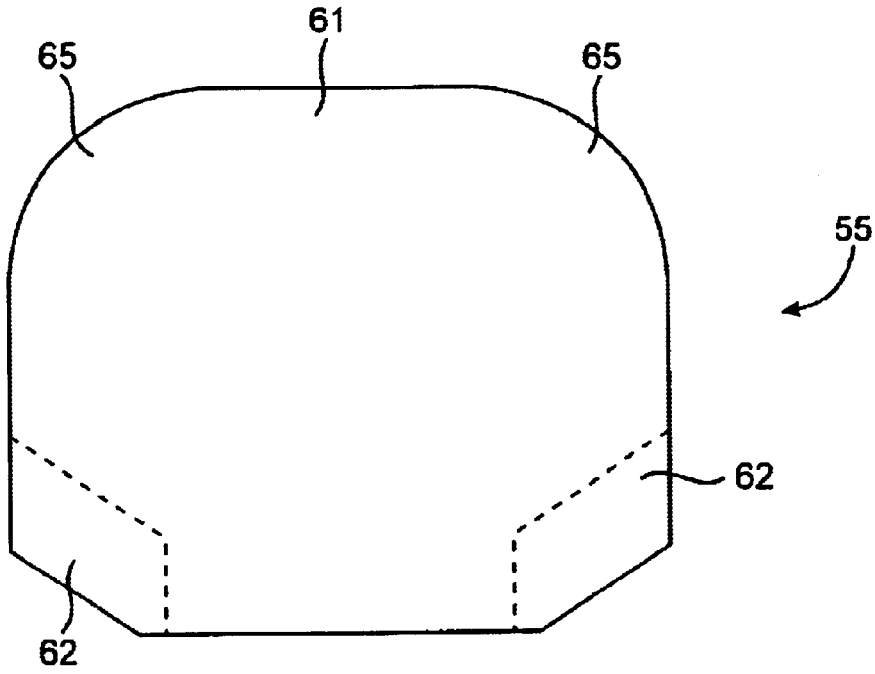
FIG. 6(*a*) shows a top view of a block element.
Figure 6B:
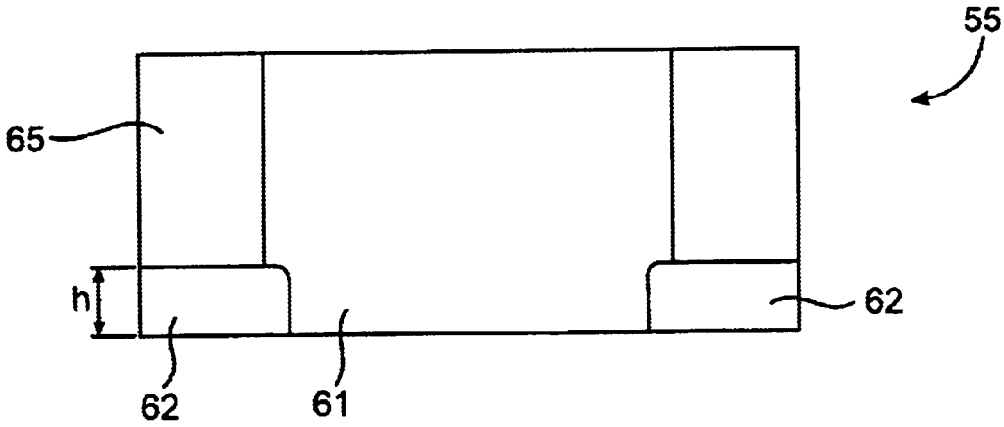

FIG. 6(*a*) shows a top view of a block element 55. FIG. 6(*b*) shows a frontal view of the block element 55 shown in FIG. 6(*a*). The block element 55 includes a central portion 61 and two side portions 65. Each side portion 65 is defined in part by a recess 62 that receives an edge region of an adjacent wearplate (not shown). In this regard, the height (h) of each recess 62 is generally greater than the thickness of the wearplate 35.

Figure 7:
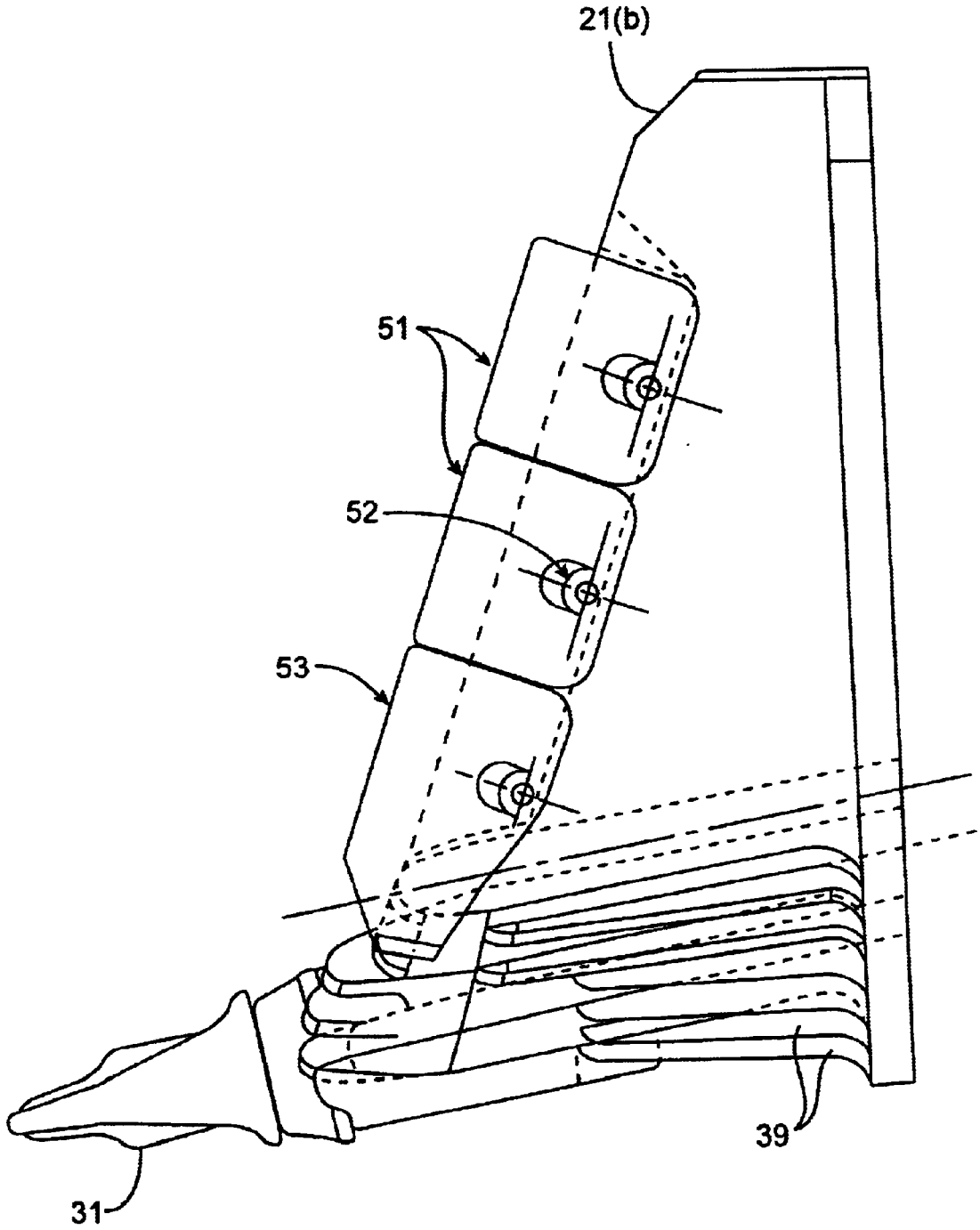
FIG. 7 shows a side and underside view of a lip assembly according to an embodiment of the invention with the stabilizing members being visible.

FIG. 7 shows the side and underside of the lip assembly. As shown in FIG. 7, a number of stabilizing members 39 are present on the underside 39 of the lip assembly and inhibit the teeth 31 of the tooth assemblies from moving laterally. A wing 21(*b*) of the lip 20 may include wing shrouds 51 and a corner shroud 53. The shrouds 51, 53 may be secured to the lip 20 by one or more securing mechanisms such as pins 52. The wing shrouds 51 and the corner shroud 53 protect the wing 21(*b*) of the lip 20 from damage during excavation. Once damaged, the various shrouds can be replaced, thus extending the useful life of the lip 20.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed. Moreover, any one or more features of any embodiment of the invention may be combined with any one or more other features of any other embodiment of the invention, without departing from the scope of the invention.

What is claimed is:

1. A lip assembly comprising:

(a) a U-shaped lip having (i) an upper surface, (ii) a lower surface, (iii) a front portion having projections and valleys, (iv) a rear portion, (v) a first plurality of holes disposed between the front portion and the rear portion and extending from the upper surface to the lower surface, (vi) a second plurality of holes disposed at the front portion, (vii) a plurality of ribs at the lower surface of the lip, wherein each hole of the first plurality of holes is disposed between a pair of ribs to inhibit the lateral movement of a tooth assembly disposed between the pair of ribs, and (viii) a plurality of lip shrouds respectively disposed on the projections of the front portion of the lip; and (b) a plurality of tooth assemblies extending away from the lip and respectively coupled to the lip via the first plurality of holes.

2. The lip assembly of claim 1 wherein the ribs in the pair of ribs are spaced by a distance approximately equal to the width of the tooth assembly disposed between the pair of ribs.

3. The lip assembly of claim 1 wherein the ribs are welded to a main body of the lip.

4. The lip assembly of claim 1 wherein the lip further comprises a plurality of block members respectively disposed at the ends of the tooth assemblies.

5. A lip assembly comprising:

a lip having an upper surface, a lower surface, a front portion, a rear portion, a plurality of holes disposed between the front portion and the rear portion and extending from the upper surface to the lower surface, and a plurality of support members, wherein each support member is disposed adjacent to a hole from the plurality of holes and inhibits lateral movement of a tooth assembly coupled to the hole; and a plurality of tooth assembly extending away from the lip and respectively coupled to the lip via the plurality of holes, wherein the plurality of holes is a first plurality of holes, and wherein the lip further comprises a second plurality of holes disposed at the front portion of the lip; and wherein the lip assembly further comprises:

a plurality of lip shrouds on the front portion of the lip, wherein the lip shrouds in the plurality of lip shrouds are respectively coupled to the lip via the second plurality of holes, wherein the front portion includes projections and valleys, and wherein each of the second plurality of holes is disposed between adjacent valleys.

6. An excavation bucket assembly comprising:

(a) an excavation bucket body having a front portion; and (b) a lip assembly comprising (i) a lip having an upper surface, a lower surface, a front portion, a rear portion, a plurality of holes disposed between the front portion and the rear portion and extending from the upper surface to the lower surface, and a plurality of support members, wherein each support member is disposed adjacent to a hole from the plurality of holes and inhibits lateral movement of a tooth assembly coupled to the hole, and (ii) a plurality of tooth assemblies extending away from the lip and respectively coupled to the lip via the plurality of holes, wherein the front portion includes projections and valleys and a second plurality of holes at the front portion, and wherein each of the second plurality of holes is disposed between adjacent valleys.

7. An excavation bucket assembly comprising:

(a) an excavation bucket body having a front portion and (b) a lip assembly comprising (i) a lip having an upper surface, a lower surface, a front portion, a rear portion, a plurality of holes disposed between the front portion and the rear portion and extending from the upper surface to the lower surface, and a plurality of support members, wherein each support member is disposed adjacent to a hole from the plurality of holes and inhibits lateral movement of a tooth assembly coupled to the hole, and (ii) a plurality of tooth assemblies extending away from the lip and respectively coupled to the lip via the plurality of holes, and wherein the excavation bucket further comprises a plurality of block members disposed at respective ends of the tooth assemblies.

* * * * *